US011788381B2

(12) United States Patent
Da Silva et al.

(10) Patent No.: US 11,788,381 B2
(45) Date of Patent: Oct. 17, 2023

(54) MANDRIL ASSEMBLY FOR CHEMICAL INJECTION IN OIL WELLS

(71) Applicant: PETRÓLEO BRASILEIRO S.A.—PETROBRÁS, Rio de Janeiro (BR)

(72) Inventors: Mario Germino Ferreira Da Silva, Rio de Janeiro (BR); Giselle Maria Lopes Leite Da Silva, Aracaju (BR)

(73) Assignee: PETRÓLEO BRASILEIRO S.A.—PETROBRÁS, Rio de Janeiro RJ (BR)

( * ) Notice: Subject to any disclaimer, the term of this patent is extended or adjusted under 35 U.S.C. 154(b) by 8 days.

(21) Appl. No.: 17/354,226

(22) Filed: Jun. 22, 2021

(65) Prior Publication Data

US 2022/0025734 A1 Jan. 27, 2022

(30) Foreign Application Priority Data

Jun. 22, 2020 (BR) ..... 10 2020 012768 3

(51) Int. Cl.

| | |
|---|---|
| ***E21B 34/10*** | (2006.01) |
| ***E21B 17/042*** | (2006.01) |
| ***E21B 47/06*** | (2012.01) |
| ***E21B 37/06*** | (2006.01) |

(52) U.S. Cl.

CPC ..... *E21B 34/10* (2013.01); *E21B 17/042* (2013.01); *E21B 47/06* (2013.01); *E21B 37/06* (2013.01)

(58) Field of Classification Search

None

See application file for complete search history.

(56) References Cited

U.S. PATENT DOCUMENTS

| | | | | | |
|---|---|---|---|---|---|
| 4,399,871 | A | * | 8/1983 | Adkins | E21B 34/06 137/539.5 |
| 4,562,854 | A | * | 1/1986 | Pringle | E21B 34/06 137/155 |
| 4,565,215 | A | * | 1/1986 | Cummings | E21B 34/06 137/538 |
| 4,703,805 | A | * | 11/1987 | Morris | E21B 34/102 166/324 |
| 4,984,306 | A | * | 1/1991 | Sumerix | E03D 9/02 137/218 |
| 6,148,920 | A | * | 11/2000 | McCalvin | E21B 34/063 166/324 |

(Continued)

*Primary Examiner* — Matthew Troutman
*Assistant Examiner* — Douglas S Wood
(74) *Attorney, Agent, or Firm* — Birch, Stewart, Kolasch & Birch, LLP

(57) ABSTRACT

The present invention refers to a mandrel assembly for chemical injection in use in an oil well production string where the water depth can reach 3,000 m, exerting extreme hydrostatic pressures on the mandrel. The mandrel assembly is capable of dosing the chemical fluid flow rate to avoid some types of unwanted situations in the production string, mainly related to fouling. It has the characteristic of not using injection valves having small diameters, causing the annular space between the mandrel body and the inner part to ensure greater space for the flow of chemical fluid, thus reducing the likelihood of a possible plugging. Such characteristics ensure lower maintenance interventions, thus generating lower costs and increasing well reliability.

13 Claims, 6 Drawing Sheets

(56) References Cited

U.S. PATENT DOCUMENTS

| | | | | |
|---|---|---|---|---|
| 7,699,108 | B2 * | 4/2010 | Bane | E21B 34/10 166/321 |
| 8,016,035 | B2 * | 9/2011 | Strattan | E21B 34/105 166/324 |
| 9,062,518 | B2 * | 6/2015 | Patel | E21B 41/02 |
| 9,683,424 | B2 * | 6/2017 | Cleven | E21B 23/06 |
| 10,309,201 | B1 * | 6/2019 | Hill, Jr. | E21B 43/162 |
| 11,015,421 | B2 * | 5/2021 | Hern | E21B 34/105 |
| 11,299,961 | B2 * | 4/2022 | Vick, Jr. | E21B 43/25 |
| 2010/0043897 | A1 * | 2/2010 | Grace | E21B 41/02 137/624.27 |
| 2012/0204977 | A1 * | 8/2012 | Lembcke | E21B 43/123 137/511 |

* cited by examiner

MANDRIL ASSEMBLY FOR CHEMICAL INJECTION IN OIL WELLS

FIELD OF INVENTION

The technology of the concentric chemical injection mandrel assembly may be used in the area of lift and flow of Pre-Salt and Post-Salt wells, to replace mandrels having state-of-the-art chemical injection valve that are installed in production strings of the wells.

DESCRIPTION OF THE STATE-OF-THE-ART

A chemical injection mandrel is generally used to pump chemicals into the production string of wells, aiming at dosing specific chemicals to avoid some types of problems such as corrosion inhibitors, $H_2S$ (sulfide gas) inhibitors and salt scale inhibitors, such as $BaSO_4$ (barium sulfate) $SrSO_4$ (strontium sulfate) and others.

Mandrel is equipment that is normally assembled as an integral part of the production string. Attached to it, the hydraulic lines, which are fixed to the string by clamps, are used to transport chemicals from UEP (stationary production unit) to ANM (wet Christmas tree). The hydraulic lines, from the ANM, extend to the specific depth at which the mandrel is positioned in the production string of the well.

The mandrels are equipped with chemical injection valves that are connected to the hydraulic lines, these chemical injection valves interface between the mandrel and the string, usually they have small internal diameter (ID) around ⅛", this small internal diameter of the injection valve allows its obstruction with ease.

Obstruction can occur by small pieces of metal material inside the flocks, precipitates resulting from the quality of the chemical materials being pumped, dirt resulting from the lack of effective filtration of the fluids to be pumped, which require a special class of filtration referred to as NAS 6. This obstruction when it cannot be mitigated leads to loss of functionality of the mandrel and consequently loss of injection of the product being dosed into the production string.

Several wells have lost the operation of the chemical injection mandrel and consequently problems related to absence of chemical protection such as column plugging by fouling of inorganic salts, production losses associated with reduction of inner diameter of the column by inorganic fouling, loss of $H_2S$ inhibition and etc.

Another problem that is currently under discussion is string breakage during scale inhibitor pumping, which interferes with inhibitor dosing. This phenomenon occurs when the liquid column formed within the hydraulic line creates a hydrostatic pressure which, when this column reaches a certain pressure, occurs a discharge of liquid from the inside of the line by the chemical injection valve.

The occurrence of this phenomenon affects reservoir management, as the dosage flow rate is calculated according to laboratory tests, where the percentages of inhibitor to be dosed are defined in relation to the concentration of salts present in water that is produced along with the oil, thus, after discharge, it takes a time to stabilize the flow rate again. During this interval, the well is not adequately inhibited thereby leading to scale formation in the production string of the well.

When the valve of a mandrel fails, shortly thereafter there is fouling in the production string and therefore reduction of the diameter of the string, thus creating a choke that reduces the oil production flow reaching UEP.

To solve the loss of production, it will be necessary to remove the scale in the string, requiring the production shutdown of the well. Depending on the project, it will also be necessary to use a completion rig, which is a critical resource and with high cost. In certain occasions there is the need for the use of stimulation vessels to pump scale removing chemicals, another critical and expensive resource. And it may also happen to use the intervention rig along with the stimulation vessel.

Document BR1020120104261A2 discloses a mandrel for mitigating production losses associated with plugging due to fouling in production strings of fixed platforms where depth is around 100 m. Unlike the invention that operates in wells in deep water depths (2,000 and 3,000 m) with extreme hydrostatic pressures, presenting various interfaces with subsea equipment, such as ANM. However, it has an injection ring having micro valves, which causes clogging.

Document EP2976495B1 discloses a chemical solution injection mandrel capable of inhibiting scale in the production string of an oil well. Unlike the invention, the document uses injection valves, such valves are the main reason for clogging.

Document US20040084186A discloses an apparatus and methods for releasing downhole well treatment chemicals. It provides a method for passive continuous release of well treatment chemicals inhibiting crust formation in the production string. Unlike the invention, the document uses the release/dissolution of the impregnated material in a cylindrical tube fixed to the column (external or internal) by the produced water.

The state of the art cited above does not have the unique features that will be presented in detail below.

BRIEF SUMMARY OF THE INVENTION

The present invention refers to a mandrel assembly for chemical injection to be used in an oil well production string where the water depth can reach 3,000 m, exerting extreme hydrostatic pressures on the mandrel.

The mandrel assembly is capable of dosing the flow of chemicals to avoid some types of unwanted situations in the production string, such as fouling. It has the characteristic of not using injection valves, causing the annular space between the mandrel body and the inner part to ensure greater space for the flow of chemical fluid, thus reducing the likelihood of a possible plugging. These characteristics guarantee lower maintenance interventions, thus generating lower costs.

BRIEF DESCRIPTION OF DRAWINGS

The present invention will be described in more detail hereinafter with reference to the accompanying drawings which, in a schematic and non-limiting manner of the inventive scope, depict exemplary embodiments thereof. In the drawings, we have.

DETAILED DESCRIPTION OF THE INVENTION

Figure 1:
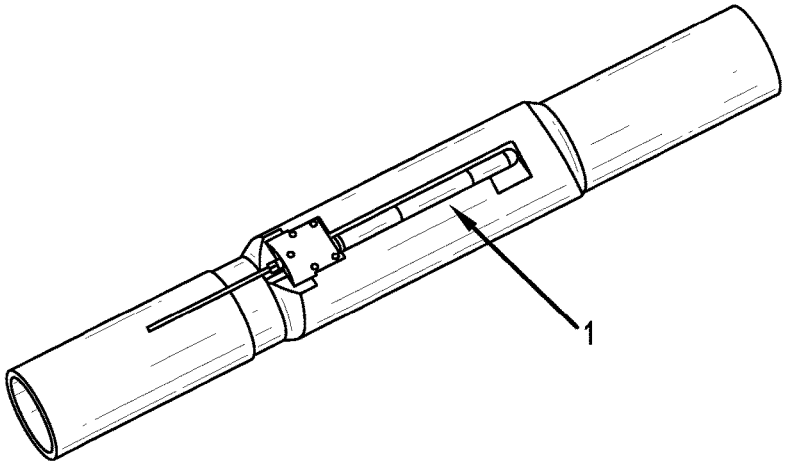
FIG. 1 illustrates the prior art chemical injection mandrel installed on the side of the production string
Figure 2:
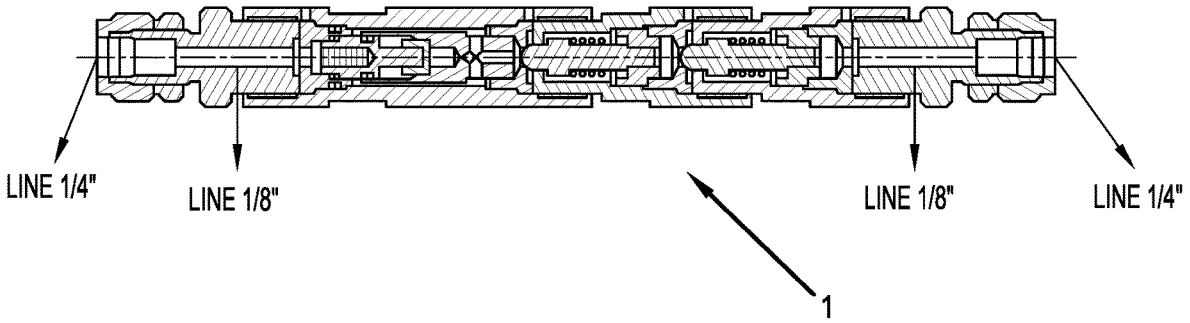
FIG. 2 illustrates the prior art chemical injection mandrel in detail
Figure 3:
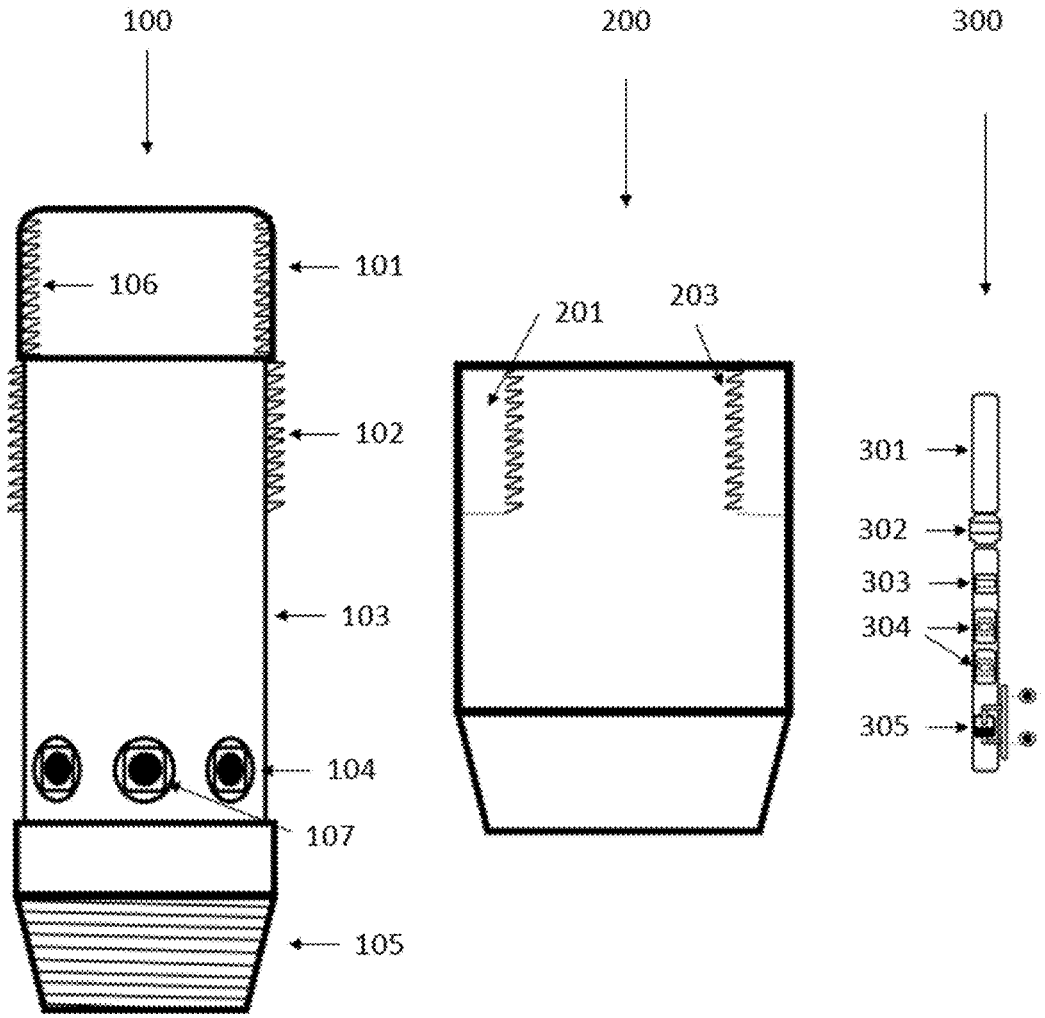
FIG. 3 illustrates the mandrel assembly of present invention

The invention mandrel assembly (2) is comprised of three main parts, namely: concentric mandrel tube (100), concentric jacket (200) and chemical injection mandrel (300), as can be seen in FIG. 3. The three parts comprise a single assembly, which although the nature of the design thereof allows to produce them independently, each part allows to facilitate the installation thereof in the exploitation and production well, in addition to being adapted to solve the recurrent technical problem of plugging the chemical injection lines of the prior art (1).

The concentric mandrel (100) depicted in FIG. 3 for chemical injection consists of three parts: the first upper part of the mandrel tube (101) has a female thread (106) and a parallel male thread (102) for coupling the cap (202). The second part, the central part of the mandrel tube (103) comprises the mandrel body receiving the concentric jacket (201) and thus comprises an annular part (3). In addition, it has side holes referred to as access devices (104), existing for the chemical to be injected into the production string. And the third, the lower part of the tube (105), preferably comprises a tapered male pin thread, but may be of the parallel male type.

A chemical injection mandrel (300) is basically comprised of a part containing a hydraulic engagement connector (302) of the injection mandrel (300) with the hydraulic line (301) and another part where the devices are inserted, being rupture disc (303) 2 check valves (304), and a pressurization device (305).

The concentric jacket (200) is made to be engaged with the concentric mandrel (100), preferably via parallel thread (203) with the parallel male thread (102), being types of threads that can ensure sealing of the chemical fluid from the annulus (3). This connection between the concentric jacket (200) and the concentric mandrel (100) forms an annulus (3), purposely placed to allow passage of the fluid into the production string. The connection between the annulus and the production string is made via access devices (104), central part of the concentric mandrel (100). The number of holes and the size thereof varies according to the required flow rate, column diameter and the need to couple a pressure valve (107).

The chemical injection mandrel (300) may be inserted directly into the solid portion (201) of the concentric jacket (200). The amount of through-holes in the solid part (201) allows placing a certain amount of chemical injection mandrel (300). This allows a concentric jacket (200) to have different amounts of chemical injection mandrel (300) for a given well, allowing for flexibility of design. Another way is to segregate the solid part (201) of the concentric jacket (200) and thus have a type of cap (202) having external thread (204), keeping the internal thread (203), which will hold onto the concentric mandrel body (100); and the external thread of the cap (204) will hold onto the wall of the concentric jacket (200) of its internal side. Likewise, the cap may contain a number of holes (205) according to the well design.

The advantage of the concentric jacket (200) is that the parts of the old chemical injection valve are already mounted in the solid space (201) intended for drilling or in the cap (202) of the concentric jacket (200) with holes (205) already predetermined. They increase the diameter of the components increasing the passage of the injection fluid eliminating all ¼" to ⅛" connections and ⅛" line segments that caused plugging during injection, and at the same time have direct communication with the annular part (3) formed between the central part of the tube (4) and the concentric jacket (200). Thus, the system will be less vulnerable to plugging by small particles.

Unlike the prior art chemical injection mandrel, the present invention brings the inclusion of a device for hydrostatic column equilibrium known as pressurization device (305), preventing breakage or spillage of all column liquid during injection of scale inhibiting fluids.

The holes (205), which may be in the cap (202) or in the solid part of the concentric jacket (200), have spaces in which pressurization devices (305) are to be housed, which are provided with springs (306) with the function of avoiding column breakage during injection of scale inhibiting fluids. The pressurization device (305) creates an intermediate pressure chamber between the pressure of inlet point (309) (chemical injection line pressure) and the pressure of outlet point (310) (reservoir static pressure or flow pressure in the annulus column-well production casing). The pressurizing device (305) has a hydrostatic pressure sensor (307,308) and a pressure control (311).

Figure 4:
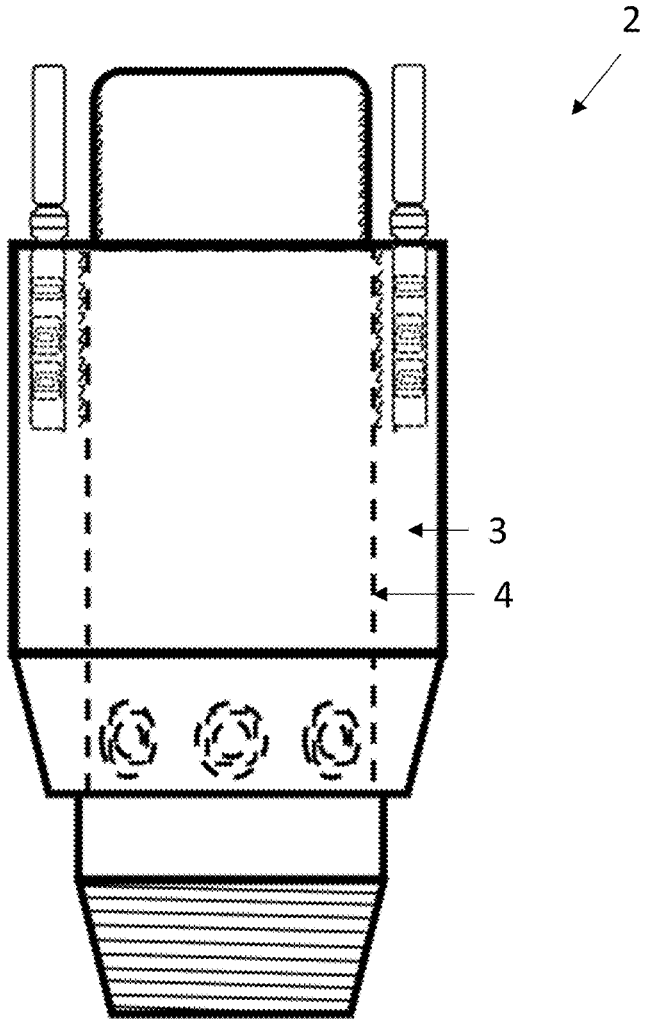
FIG. 4 illustrates all coupled parts of the mandrel assembly
Figure 5:
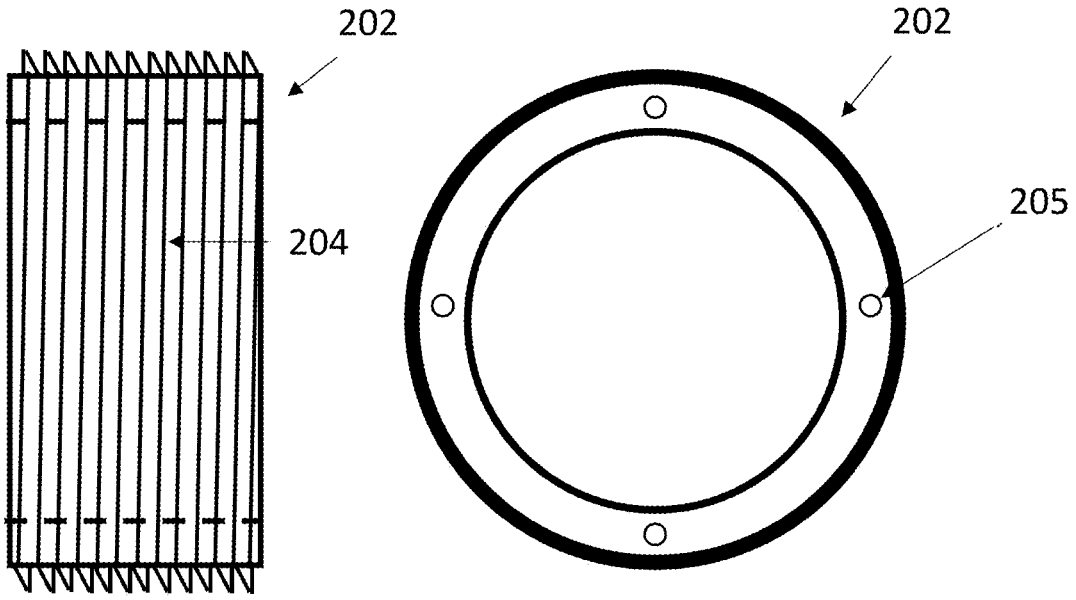
FIG. 5 illustrates the concentric jacket and its external thread
Figure 6:
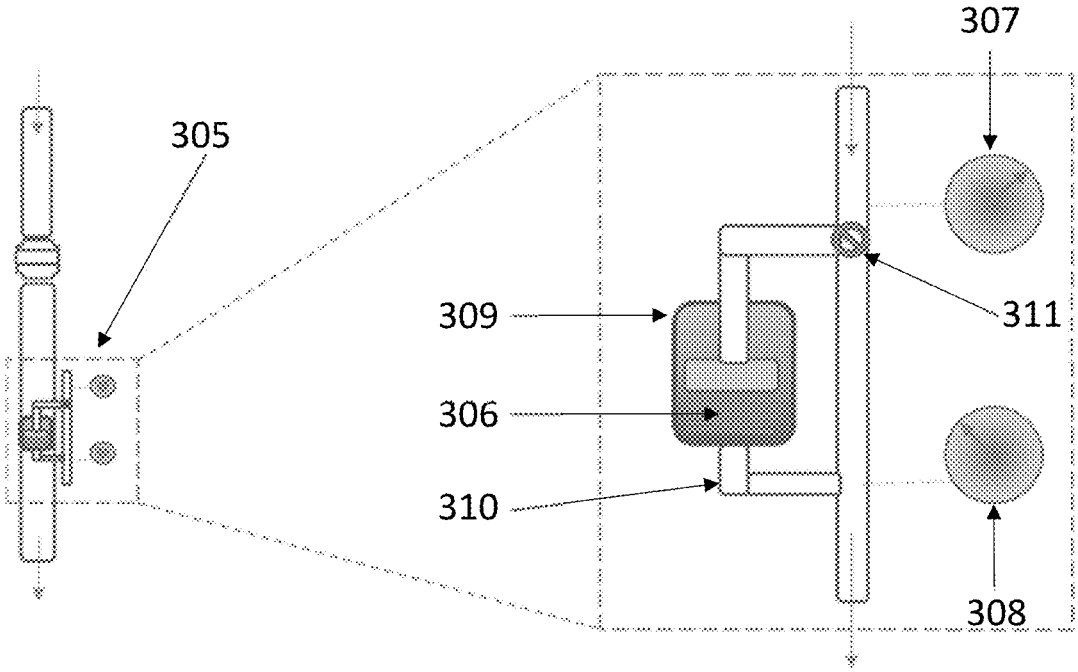
FIG. 6 illustrates the detail of the pressurization device.

FIG. 4 shows the assembly of the mandrel assembly being carried out by screwing the concentric jacket cap (200), where there is creation of the annulus (3) in place of the prior art valve, and thus increasing the diameters of the components of the chemical injection mandrel (300), such feature ultimately reduces the risk of plugging in chemical injection valves.

The technical advantages will be ensuring scale management, maintaining the production of wells due to chemical inhibition of scale and the life of the mandrel assembly (2). The economic advantages will be the guarantee of the recovery factor projected for the field through the maintenance of production, in addition to the fact that the costs related to critical resources, such as stimulation vessels and/or rigs are not necessary for the removal of scale from the production system; such as production strings, production lines, in surface equipment at UEP.

The inhibiting fluid will come from UEP through hydraulic lines (301), and pass through the rupture disc (303). This rupture disc, which is calibrated to break at a given pressure value, will be used to test hydraulic lines with pressure after mandrel installation. The fluid will follow and go through two check valves (304) that have the function of preventing the production of the well from occurring through the hydraulic lines (301). Check valves (304) are safety valves to prevent so-called blowout (uncontrolled oil production) by the chemical injection line. The inhibiting fluid will follow the pressurization devices (305) of the lines, which have the function of keeping the inhibiting fluid line always full (from UEP to mandrel), then the fluid will pass through the annulus (3), formed between the inner part of the concentric jacket (200) and the outer wall of the concentric tube (100), to the access device (104) of the mandrel to the inside of string.

In the access device (104), there may be installed a kind of pressure valve (107), which will be capable of being regulated/calibrated, to be opened with a certain pressure value applied, from its manufacturing design to work with positive pressure, to be calculated as a function of the hydrostatic pressure (calculated by the weight of the inhibiting fluid at the vertical depth of TVD design), considering the highest inhibiting fluid density value to be used in the design. Thus, the injection of chemicals into the inside of string will occur when the pressure value inside the mandrel overcomes a minimum value, driven by a pump located in UEP. This way ensures a stable and constant inhibiting fluid injection hydraulic column.

Figure 7:
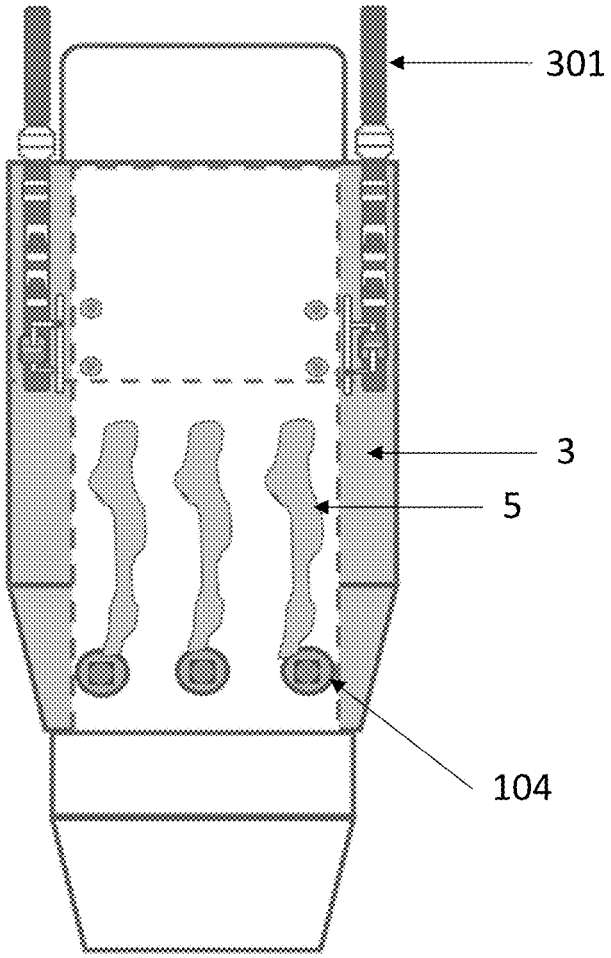
FIG. 7 illustrates the injection of inhibitor fluid.

In FIG. 7 it is possible to notice the inhibiting fluid (5) coming from filling the hydraulic line (301) traveling through the annulus (3) and being injected by the access device (104).

The number of access devices (104) will depend on the design, depending on the column diameter, 3½", 4½", 5½" and 6⅝". Thus, depending on the design, the amount of devices can be increased or decreased. It may also be due to the flow rate of the production string or the use of a pressure valve (107).

However, the assembly of the mandrel assembly (2) in the production string is facilitated, once the concentric mandrel tube (100) is fitted to the string, being enough to displace the concentric jacket (200), which has a larger internal diameter than the production string, until reaching the threads (102) of the concentric tube (100). In addition, the various chemical injection mandrels (300) are already pre-installed in the concentric jacket (200) or cap (202), avoiding detailed assemblies during installation in the well string. An unused chemical injection hydraulic line (301) may be replaced by another as there will be no return of the produced oil, increasing the reliability of the well.

The invention claimed is:

1. A chemical injection mandrel assembly for a hydrostatic pressure well comprising:

a concentric mandrel tube including an upper portion, a central portion, and a lower portion, the upper portion having a male thread and the central portion including one or more access holes;

a concentric jacket including a solid portion including one or more holes and an internal female thread configured to couple the concentric jacket with the concentric mandrel tube by engaging the male thread, the coupling of the concentric jacket and the concentric mandrel tube forming an annulus covering the central portion of the concentric mandrel tube; and a chemical injection mandrel including a pressurization device, the chemical injection mandrel being inserted in one of the one or more holes in the solid portion of the concentric jacket such that the pressurization device is housed within the holes of the solid portion of the concentric jacket, wherein the annulus allows for passage of fluid from the chemical injection mandrel to a production string of the hydrostatic pressure well via the one or more access holes of the concentric mandrel tube.

2. The chemical injection mandrel assembly according to claim 1, wherein the chemical injection mandrel further includes a hydraulic connector, a rupture disc, and two check valves.

3. The chemical injection mandrel assembly according to claim 1, wherein the concentric jacket further includes a cap and the internal female thread and solid portion of the concentric jacket are part of the cap.

4. The chemical injection mandrel assembly according to claim 1, wherein the pressurization device includes a spring.

5. The chemical injection mandrel assembly of claim 4, wherein the pressurization device creates an intermediate pressure chamber between a pressure of the chemical injection line and a reservoir static pressure or flow pressure in the production string.

6. The chemical injection mandrel assembly of claim 5, wherein the pressurization device further includes a hydrostatic pressure sensor and a pressure control.

7. The chemical injection mandrel assembly according to claim 1, further comprising a pressure valve in each of the one or more holes of the central portion of the concentric mandrel tube.

8. The chemical injection mandrel assembly of claim 7, wherein the each pressure valve is capable of being regulated/calibrated to work with positive pressure at a true vertical depth at which the production string of the hydrostatic pressure well is installed.

9. The chemical injection mandrel assembly of claim 8, wherein the positive pressure is calculated as a function of a hydrostatic pressure of a highest density of a substance contained in an inhibitory fluid mixture.

10. The chemical injection mandrel assembly according to claim 7, wherein the pressure valve starts injection into the production string when a pressure value inside the mandrel overcomes a preset minimum value, given a discharge pressure of a pump installed in a stationary production unit.

11. The chemical injection mandrel assembly of claim 1, wherein a number of access holes in the central portion of the concentric mandrel tube is as a function of a diameter of the production string, a production flow rate of the hydrostatic pressure well or a need of the pressure valve contained within the one or more holes.

12. The chemical injection mandrel assembly according to claim 1, wherein the concentric tube further includes a female thread at the upper portion.

13. The chemical injection mandrel assembly according to claim 1, wherein the concentric tube further includes a male conical or male parallel thread at the lower portion.

* * * * *